US005108318A

United States Patent [19]

Sakurai et al.

[11] Patent Number: 5,108,318

[45] Date of Patent: Apr. 28, 1992

[54] FEMALE TERMINAL

[75] Inventors: Kazuaki Sakurai; Yuji Hatagishi; Masayuki Yamamoto, all of Shizuoka, Japan

[73] Assignee: Yazaki Corporation, Japan

[21] Appl. No.: 672,568

[22] Filed: Mar. 20, 1991

[30] Foreign Application Priority Data

Mar. 22, 1990 [JP] Japan ..... 2-28199[U]

[51] Int. Cl.[5] ..... H01R 13/00

[52] U.S. Cl. ..... 439/744; 439/843

[58] Field of Search ..... 439/744, 283, 843

[56] References Cited

U.S. PATENT DOCUMENTS

| | | | |
|---|---|---|---|
| 3,317,887 | 5/1967 | Henschen et al. | 439/744 |
| 3,366,921 | 1/1968 | Culver | 439/744 |
| 4,278,317 | 7/1981 | Gallusser et al. | 439/744 |
| 4,571,017 | 2/1986 | Fujita | 439/744 |
| 4,734,064 | 3/1988 | Knapp et al. . | |
| 4,834,678 | 5/1989 | Emadi et al. | 439/744 |

FOREIGN PATENT DOCUMENTS 63-102182 5/1985 Japan .

*Primary Examiner*—Joseph H. McGlynn
*Attorney, Agent, or Firm*—Wigman & Cohen

[57] ABSTRACT

A female terminal includes a female terminal member and a protective sleeve. The female terminal member has a receptacle section to which a male terminal is to be connected and an electrical wire connecting section to which an electrical wire is to be connected. The receptacle section has a base cylindrical part and a flexible contact part extending from the base cylindrical part. The protective sleeve for protectively covering the receptable section of the female terminal member is fitted around the receptacle section. The sleeve has a base cylindrical portion fixedly fitted onto the base cylindrical part of the receptacle section and an enlarged diameter portion integrally connected to the base cylindrical portion through a step portion. When the female terminal thus constituted is fitted in a connector housing, at least one stopper arm provided in the connector housing come to engage with the step portion to securely hold the female terminal in the housing. The engagement between the stopper arm and the step portion of the female sleeve is made relatively near from a front opening of the housing.

2 Claims, 2 Drawing Sheets

FEMALE TERMINAL

BACKGROUND OF THE INVENTION

1. Field of the Invention

This invention relates to a female terminal, and in particular to a female terminal used in an electrical connector for use in a wiring harness for an automobile, which has a protective sleeve for protectively covering a female receptacle section of a female terminal member of the female terminal.

2. Description of the Prior Art

A known female terminal having a protective sleeve is shown in FIG. 1. In the figure, the reference numeral 1 denotes a female terminal which includes a female terminal member 2 and a protective sleeve 3.

The female terminal member 2 has a female receptacle section 4 at a front side thereof and an electrical wire connecting section 5 at a rear side thereof to which an electrical wire 6 is connected. The female receptacle section 4 has a plurality of flexible contacts 4*a* which form a female receptacle 4*b* to which a male terminal (not shown) is to be fitted.

Around the female receptacle section 4, the cylindrical protective sleeve 3 is fitted. The cylindrical sleeve 3 serves to prevent the contacts 4*a* from being exceedingly deformed outwardly to protect the female receptacle section 4.

Between the female receptacle section 4 and the wire connecting section 5 of the female terminal member 2, there is formed an engagement portion 7 having a collar-like configuration. Thus formed engagement portion 7 is located substantially at the center of the terminal member 2.

In use of the female terminal 1 having the above structure, the female terminal 1 is inserted into one of cavities 8 in a connector housing 9. As shown in FIG. 2, when the female terminal 1 is properly fitted in the cavity 8 of the connector housing 9, stopper arms 10 protrudingly provided inside the cavity 8 come to engage with the engagement portion 7 of the terminal member 2 so as to prevent the terminal 1 will be fallen out from the cavity 8. In this situation, since the engagement portion 7 is formed substantially at the center of the female terminal member 2, the engagement portion 7 is positioned at the middle of the cavity 8. This means that the stopper arms 10 are in engagement with the engagement portion 7 at the position far from a front or rear opening 9*a* or 9*b* of the cavity 8 of the connector housing 9.

As a result of the position of the engagements between each arm 10 and the engagement portion 7 of the terminal member 2, when a spacer 11 which ensures the engagement between the stopper arm 10 and the engagement portion 7 by preventing the arm 10 from being loosened is inserted into a space between the arm 10 and the inner surface of the cavity 8 from the front opening 9*a* of the housing 9, the length of the spacer 11 has to be long in accordance with the distance from the front opening 9*a* to the position at which the stopper arm 10 is located. Further, when the stopper arms 10 are disengaged from the engagement portion 7 by a releasing tool (not shown) which releases the engagement between each stopper arm 10 and the engagement portion 7 in order to remove the female terminal 1 from the housing 9, the releasing operation has to be done at the middle position in the cavity, thus making the operation very difficult.

SUMMARY OF THE INVENTION

In view of the above problems, a main object of the present invention is to provide an improved female terminal with a protective sleeve, wherein the operation for releasing the engagement between the female terminal and a locking arm in a cavity of a connector housing in which the female terminal is fitted can be easily performed.

Another object of the present invention is to provide a female terminal in which a spacer for ensuring the engagement between the stopper arm and the female terminal can be shortened in comparison with that used in the known female terminal.

In order to achieve these objects, the female terminal according to the present invention comprises a female terminal member having a female receptacle section to which a male terminal is to be connected and an electrical wire connecting section to which an electrical wire is to be connected. The receptacle section has a base cylindrical part and a flexible contact part extending from the base cylindrical part. A protective sleeve for protectively covering the receptacle section of the female terminal member is fitted around the receptacle section. The protective sleeve has a base cylindrical portion fixedly fitted onto the base cylindrical part of the receptacle seciton of the female terminal member and an enlarged diameter portion integrally connected to the base cylindrical portion through a step portion with which at least one stopper arm provided in a connector housing is to be engaged when the female terminal is fitted in the connector housing.

According to the female terminal having the above structure, the stopper arm is in engagement with the step portion of the sleeve at the position relatively near from a front opening of the connector housing. Therefore, it becomes possible to make the operation which releases the engagement between the stopper arm and the step portion by a releasing tool relatively easy. Further, since the stopper arm is positioned relatively near from the front opening, the length of a spacer which is to be inserted from the front opening into the housing in order to ensure the engagement between the stopper arm and the step portion of the protective sleeve can be shortened in comparison with the spacer used in the known terminal as described above. Furthermore, since the sleeve has the enlarged diameter portion at the front side thereof, the amount that the flexible contact part can be flexibly displaced in the radial direction of the sleeve becomes relatively large, which makes the insertion of the male terminal to the female receptacle section easy.

According to the present invention, it is preferable that the base cylindrical portion of the protective sleeve is fixedly fitted onto the base cylindrical part of the receptacle section of the female terminal member by a plurality of indents.

Other objects, features and advantages of the present invention will become apparent from the following description of the preferred embodiments taken in conjunction with the accompanying drawings.

DETAILED DESCRIPTION OF THE PREFERRED EMBODIMENT

Figure 1:
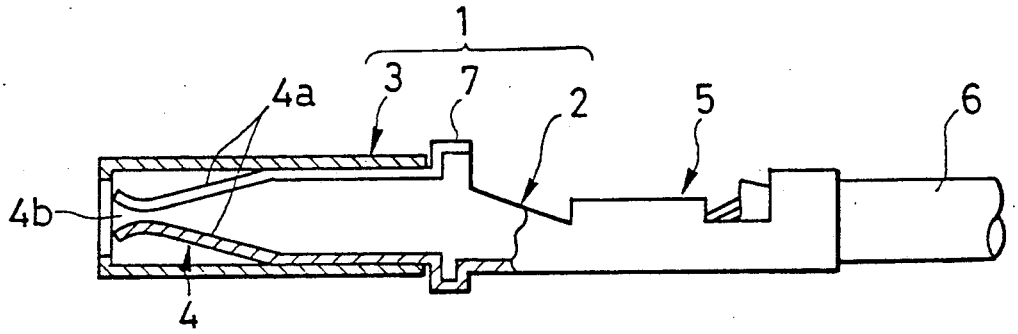
FIG.1 PRIOR ART
FIG. 1 is a partially sectional view of the known female terminal with a protective sleeve.
Figure 2:
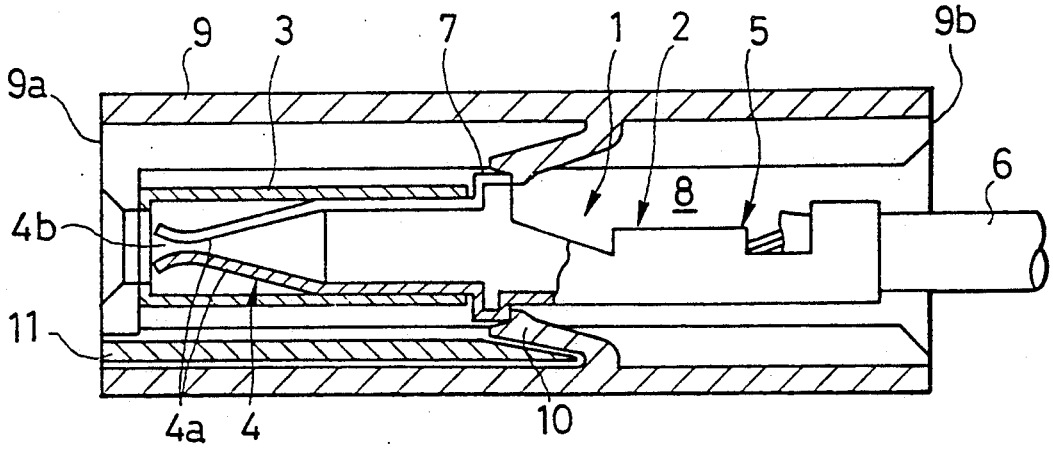
FIG.2 PRIOR ART
FIG. 2 is a sectional view which shows the condition that the female terminal is fitted inside a connector housing.

Referring now to the drawings, a preferred embodiment of a female terminal according to the present invention will be described.

Figure 3:
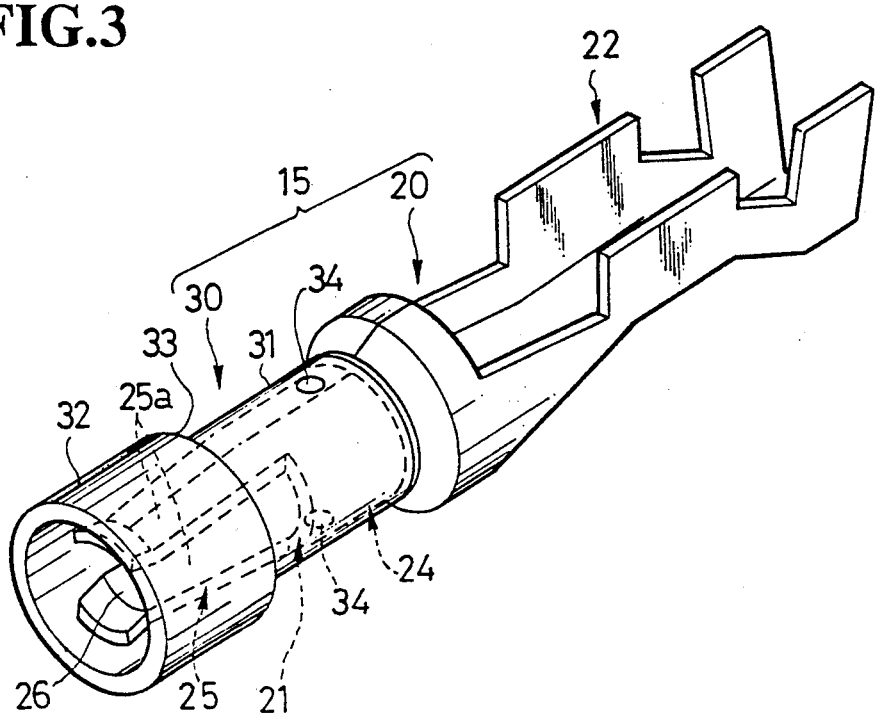
FIG. 3 is a perspective view of an embodiment of a female terminal according to the present invention.

FIG. 3 is a perspective view of an embodiment of a female terminal according to the present invention. In the FIGURE, the reference numeral 15 denotes a female terminal which includes a female terminal member 20 and a protective sleeve 30.

The female terminal member 20 which is formed of a conductive metal material has a receptacle section 21 to which a male terminal (not shown) is to be connected and an electrical wire connecting section 22 to which an electrical wire 23 is to be connected. The female receptacle section 21 has a base cylindrical part 24 and a flexible contact part 25 extending from the base cylindrical part 24. The flexible contact part 25 is formed from two flexible contacts 25*a* which are opposed to each other through a certain space 26 therebetween. The flexible contacts 25*a* form a female receptacle into which the male terminal is to be inserted to establish an electrical connection between the female and male terminals.

The protective sleeve 30 for protectively covering the receptacle section 21 of the female terminal member 20 is provided around the receptacle section 21 so as to surround it. The protective sleeve 30 is preferably formed from a conductive metal material. The protective sleeve 30 has a base cylindrical portion 31 and an enlarged diameter portion 32 integrally and coaxially connected to the base cylindrical portion 31 through a step portion 33. The base cylindrical portion 31 of the sleeve 30 is fixedly fitted onto the base cylindrical part 24 of the receptacle section 21 through a plurality of indents 34 which are formed on the base cylindrical part 24 and the base cylindrical portion 31, respectively.

Figure 4:
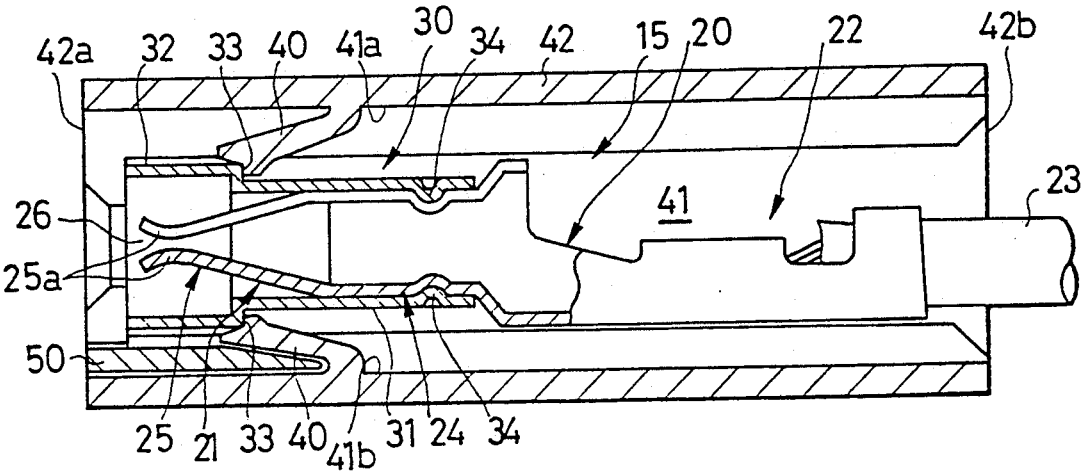
FIG. 4 is a sectional view which shows the condition that the female terminal of the embodiment of the present invention is fitted inside a connector housing.

As clearly illustrated in FIGS. 3 and 4, the length of the enlarged diameter portion 32 measured in the axial direction thereof is shorter than that of the base cylindrical portion 31 in such a manner that the step portion 33 is located relatively near from the front tip portion of the female terminal 15. Further, the diameter of the enlarged diameter portion 32 is larger than that of the base cylindrical portion 31 so as to allow the flexible contacts 25*a* to be sufficiently displaced therein.

As clearly illustrated in FIG. 4, there are formed two stopper arms 40 in a cavity 41 of a housing 40 in which the female terminal thus constituted is to be fitted. The stopper arms 40 are flexibly projected toward a front opening 42*a* of the cavity 41 of the housing 40 from upper and lower inner surfaces 41*a*, 41*b* of the housing 42 which define the cavity 41 of the connector housing 42. These stopper arms 40 will be engaged with the step portion 33 of the sleeve 30 when the female terminal 15 is fitted into the cavity 41 of the housing 42 to hold the female terminal 15 in the cavity 41securely.

FIG. 4 shows the condition that the female terminal 15thus constituted is actually fitted inside the cavity 41 of the connector housing 42. The female terminal 15 has been inserted into the cavity 41 from a rear opening 42*b* of the housing 42 until the enlarged diameter portion 32 of the sleeve 30 passes the stopper arms 40 and then the stopper arms 40 are engaged with the step portion 33 of the sleeve 30. Under the condition, a spacer 50 for preventing the lower arm 40 from being disengaged from the step portion 33 of the sleeve 30 to ensure the engagement between the stopper arm 40 and the step portion 33 is inserted from the front opening 42*a* of the housing 42 into the space between the stopper arm 40 and the lower surface 41*b* of the connector housing 42.

As clearly shown in FIG. 4, according to the female terminal of this embodiment, the stopper arms 40 are in engagement with the step portion 33 of the sleeve 30 relatively in the vicinity of the front opening 42*a* within the cavity 41, thus making the operation that releases the engagement between each stopper arm 40 and the step portion 33 of the sleeve 30 with a releasing tool (not shown) easy. Further, it also appears that the length of the spacer 50 can be shortened in comparison with that used in the known female terminal. Furthermore, the enlarged diameter portion 32 of the sleeve 30 allows the flexible contacts 25*a* to be sufficiently displaced in the sleeve so as to make the insertion of the male terminal into the space 26 between the flexible contacts 25*a* easy.

It will be apparent from the foregoing description that the female connector of the present invention has a number of advantages, some of which have been described above. Also, obvious modifications and variations can be made to the female terminal of the present invention without departing from the scope of the invention. Accordingly, the scope of the invention is not limited as necessitated by the accompanying claims.

What is claimed is:

1. A female terminal to be fitted in a connector housing cavity which includes an inner surface and a front opening, said female terminal comprising:

a terminal member having an electrical wire connecting section to which an electrical wire is to be connected and a female receptacle section, said receptacle section including means for receiving a male terminal and comprising a base cylindrical part and a flexible contact part extending from the base cylindrical part adapted for receiving the male terminal therein, and a flexible contact part having a tip part; and means for protectively covering only the receptacle section of the female terminal member, comprising a protective sleeve which further includes:

a base cylindrical portion fixedly fitted onto the base cylindrical part of the receptacle section;

an enlarged diameter portion integrally connected to the base cylindrical portion for allowing sufficient deformation of the tip part of the flexible contact part to make the insertion of the make terminal easy when the male terminal is connected to the female terminal; and a stepped portion circumferentially formed between the base cylindrical portion and the enlarged diameter portion, with at least one stopper arm protrudingly provided on the inner surfaces of the cavity of the connector housing and adapted to be engaged when the female terminal is fitted in the cavity to secure the female terminal in the cavity, the stepped portion being located substantially around a middle portion of the flexible contact part such that the engagement between the stepped portion and the stopper arm is made at a position relatively close to the front opening of the cavity when the female terminal is properly fitted in the cavity.

2. A female terminal as claimed in claim 1, wherein the base cylindrical portion of the protective sleeve is fixedly fitted onto the base cylindrical part of the receptacle section of the female terminal member by means of a plurality of indentations.

* * * * *